US008776332B2

(12) United States Patent
Kosh et al.

(10) Patent No.: US 8,776,332 B2
(45) Date of Patent: Jul. 15, 2014

(54) PUSH BUTTON BUCKLE WITH INTERCHANGEABLE COVERS

(75) Inventors: Matthew Kosh, Seattle, WA (US); John N. Tilden, Seattle, WA (US)

(73) Assignee: Bodypoint, Inc., Seattle, WA (US)

( * ) Notice: Subject to any disclaimer, the term of this patent is extended or adjusted under 35 U.S.C. 154(b) by 957 days.

(21) Appl. No.: 12/716,969

(22) Filed: Mar. 3, 2010

(65) Prior Publication Data

US 2011/0214259 A1 Sep. 8, 2011

(51) Int. Cl.
*A44B 19/26* (2006.01)

(52) U.S. Cl.
USPC ..... 24/633; 24/163 R; 24/163 K

(58) Field of Classification Search
USPC ..... 24/163 K, 163 R, 633
See application file for complete search history.

(56) References Cited

U.S. PATENT DOCUMENTS

| | | | | |
|---|---|---|---|---|
| 3,179,992 | A | | 4/1965 | Murphy, Sr. |
| 3,331,108 | A | | 7/1967 | Fisher |
| 3,349,445 | A | | 10/1967 | Foster et al. |
| 3,449,800 | A | | 6/1969 | Fisher |
| 3,481,009 | A | | 12/1969 | Preston |
| 3,494,007 | A | | 2/1970 | Dahms |
| 3,594,872 | A | | 7/1971 | Kulwin et al. |
| 3,708,838 | A | | 1/1973 | Gonzalez |
| 3,818,548 | A | * | 6/1974 | Meyerson ..... 24/170 |
| 4,092,767 | A | | 6/1978 | Narayan |
| 4,604,772 | A | * | 8/1986 | Arff ..... 24/68 R |
| 4,642,857 | A | | 2/1987 | Ono |
| 4,731,912 | A | * | 3/1988 | Boriskie et al. ..... 24/633 |
| 4,766,654 | A | | 8/1988 | Sugimoto |
| 4,939,824 | A | | 7/1990 | Reed |
| 4,987,662 | A | * | 1/1991 | Haffey et al. ..... 24/633 |
| 6,041,480 | A | * | 3/2000 | White ..... 24/633 |
| 6,145,169 | A | * | 11/2000 | Terzuola et al. ..... 24/170 |
| 6,665,913 | B2 | | 12/2003 | Kosh |
| 2002/0112327 | A1 | | 8/2002 | Baloga |
| 2004/0195281 | A1 | | 10/2004 | Hung |
| 2005/0115031 | A1 | | 6/2005 | Tanaka |
| 2005/0241123 | A1 | | 11/2005 | Willard |
| 2007/0044284 | A1 | | 3/2007 | Fok |
| 2009/0083955 | A1 | | 4/2009 | Smith |
| 2009/0126170 | A1 | | 5/2009 | Guerra |

OTHER PUBLICATIONS

Bodypoint, Inc., Seattle, Washington, "Buckle Security Covers" brochure, copyright 2009.
International Search Report and Written Opinion mailed Oct. 10, 2011 in Application No. PCT/US2011/026917, filed Mar. 2, 2011, 20 pages.
Canadian Patent Application No. 2,791,582, Official Letter mailed Nov. 26, 2013.

* cited by examiner

*Primary Examiner* — Robert J Sandy
(74) *Attorney, Agent, or Firm* — Kilpatrick Townsend & Stockton LLP

(57) ABSTRACT

A push button buckle (20) having a replaceable cover (30). A button (38) is biased into contact with the cover (30) to aid in installation. The cover (30) flexes to snap onto the frame (50), and is removed with a tool (T).

38 Claims, 10 Drawing Sheets

PUSH BUTTON BUCKLE WITH INTERCHANGEABLE COVERS

BACKGROUND

A buckle is a device used for releasably fastening two items together, with one item attached to the buckle and the other attached to a catch, such as a tongue. One style of conventional buckle is a push button buckle, used for example on seat belts and other applications which require a secure, releasable attachment. Such push button buckles releasably connect two ends of webbing to provide a secure, safe attachment that can be released by pushing a button on the buckle.

Description of Background Art. The following U.S. patents and Publications may describe relevant background art:

| | |
|---|---|
| 3,331,108 (Fisher) | 3,449,800 (Fisher) |
| 3,481,009 (Preston) | 3,494,007 (Dahms) |
| 3,708,838 (Gonzalez) | 4,642,857 (Ono) |
| 4,766,654 (Sugimoto) | 4,939,824 (Reed) |
| 6,665,913 (Kosh) | 4,092,767 (Narayan) |
| 20020112327 (Baloga) | 20050115031 (Tanaka) |
| 20050241123 (Willard) | 20070044284 (Fok) |
| 20090083955 (Smith) | 20090126170 (Guerra) |

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with embodiments, a method is provided for replacing a cover on a buckle. The method includes removing a first cover for the buckle from a frame for the buckle; and installing a second cover on the frame. The first and second covers each are exposed, when installed on the frame, to a latch mechanism in the frame.

In accordance with embodiments, installing includes attaching a first end of the cover to the frame; rotating the cover on the frame and about the first end; engaging an engagement surface of the cover with a sloped surface of the frame; pressing the cover downward, causing the engagement surface to move along the sloped surface, thus flexing the cover; and releasing the flex of the cover to lock the cover around a structure on the frame.

In embodiments, removing the first cover includes inserting a tool into a notch formed between a frame for the buckle and a first cover for the buckle; and prying the cover off the frame using the tool.

In further embodiments, a method is provided for customizing a buckle for a user. The method includes selecting a user device having a buckle frame for a user; selecting a cover for the buckle based upon the user's needs; and installing the cover on the buckle frame so that the cover is exposed to a latch mechanism in the frame. Selecting a cover may include selecting a cover that requires a tool for actuation of the latch mechanism, or selecting a cover with a larger opening to permit a user with limited dexterity to open the buckle, as examples.

In accordance with still further embodiments, a push button buckle is provided. The buckle includes a frame; a latch mechanism mounted in the frame; and a cover releasably mounted to the frame and, when mounted to the frame, exposed at least in part to the latch mechanism.

A push button can be mounted for rotation within the cover, and the push button can be biased into contact with the cover to aid in installation of the cover. In embodiments, the push button is biased by contact of a spring loaded surface on the push button with a surface on the cover.

In further embodiments, the cover includes an engagement surface and the frame includes a sloped surface. The engagement surface engages the sloped surface to flex the cover when the cover is installed on the frame. The frame can include a protrusion for maintaining the engagement surface when the cover is installed on the frame.

In embodiments, one of the frame and the cover includes a recess, and the other of the frame and the cover includes a protrusion. The protrusion seats in the recess when the cover is installed on the frame.

In still further embodiments, a tool receiving structure is formed between the cover and the frame when the cover is installed on the frame, the tool receiving structure for receiving a tool for prying the cover off the frame. The tool receiving structure may be, for example, a notch.

In embodiments, a push button buckle is provided, having a frame; a latch mechanism mounted in the frame; a cover releasably mounted to the frame; and a tool receiving structure formed between the cover and the frame when the cover is installed on the frame, the tool receiving structure for receiving tool for prying the cover off the frame. The tool receiving structure may be, for example, a notch.

In still further embodiments, a push button buckle is provided, including a frame; a latch plate mounted in the frame and movable between a release position in which a tongue is removable from the buckle and a lock position in which the tongue is locked in the buckle; a latch spring mounted in the frame to bias the latch plate to the lock position; and an ejection spring, attached to but separate from the latch spring, for aiding in ejecting a tongue from the buckle. The latch spring can include a leaf spring mounted under the latch plate and having at least one loop at one end, and the ejection spring can be a torsion spring mounted in said at least one loop of the leaf spring.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
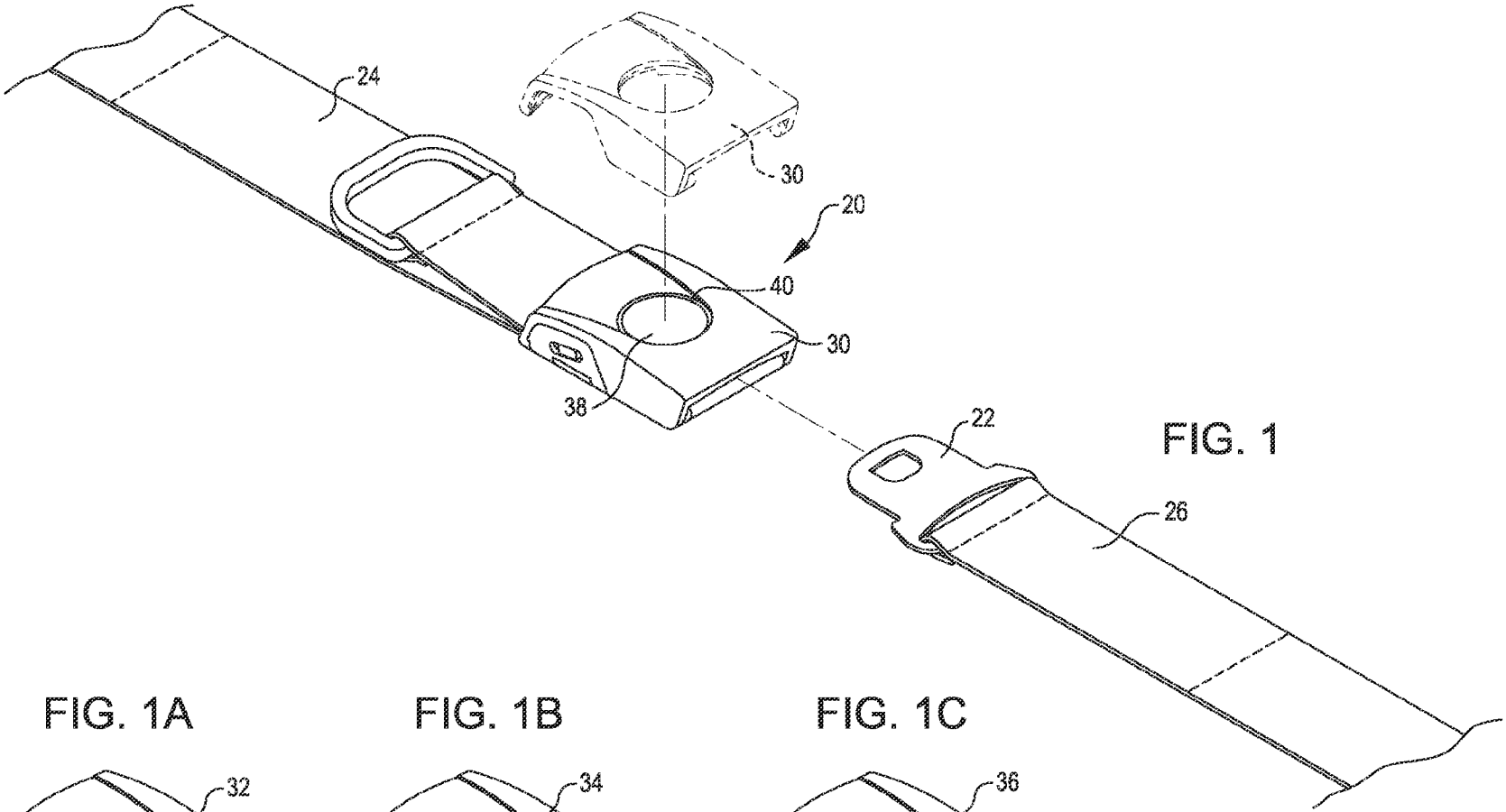
FIG. 1 is a side perspective view of a buckle that is connectable to a tongue and that includes a replaceable cover in accordance with embodiments.

Referring now to the drawings, in which like reference numerals represent like parts throughout the several views, FIG. 1 shows a push button buckle 20 that is releasably connectable to a tongue 22, in accordance with embodiments. In the embodiment shown in FIG. 1, the push button buckle 20 and the tongue 22 are connected to webbing straps 24, 26, but the buckle and/or the tongue can be connected to other structures. The buckle 20 and tongue 22 can be used in a variety of applications, including for use with seat belts, wheelchair accessories, sporting goods, or in any application in which two structures need to be releasably connected in a secure manner to one another.

Figure 1C:
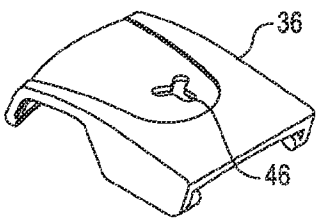
FIGS. 1A, 1B, and 1C show alternate embodiments of covers that can be used with the buckle of FIG. 1.
Figure 1B:
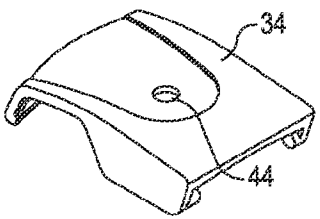
Figure 1A:
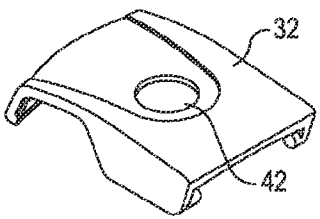

In accordance with embodiments, the push button buckle 20 includes a removable cover 30. This removable cover 30 can be detached from the buckle 20 and replaced with another cover, such as the alternate covers 32, 34, 36 shown in FIGS. 1A, 1B, and 1C, respectively. The removable covers 30, 32, 34, 36 are interchangeable, and can be changed by a user, salesperson, installer, repair person, assembler, caregiver, a therapist, a healthcare provider, security personnel, parent, or another individual. A push button 38 is mounted so that it can be accessed through the cover. In the embodiments shown in the drawings, the push button 38 is connected for removal with the removable cover 30 (or any of the other removable covers 32, 34, 36), but such an arrangement is not necessitated in all embodiments. Interaction between the push button 38 and the removable cover 30 is described below with respect to some embodiments.

The fact that the cover 30 is removable and/or easily installable provides a number of benefits. First, a user or installer can alter the color and/or design of the removable cover 30 and/or the push button 38 without having to replace the entire buckle. Moreover, as described below, in accordance with some embodiments, such an alteration can be made without disconnecting the buckle 20 from the strap 24. Second, the cover 30 and/or the push button 38 can be altered so as to change the mechanism by which the push button buckle 30 is unlatched. As examples, the removable cover 30 includes a large, round opening 40 that can be engaged by a finger of a user so as to release a latch within the buckle 20. The removable cover 32, on the other hand, includes a medium-sized, round opening 42 that receives a smaller finger and can require more dexterity for releasing of the latch in the buckle 20. The cover 34 includes a very small round opening 44 that can require a tool, key, pencil, or other structure for inserting through the opening to release the latch. Thus, with the cover 34, a safety feature is added to the buckle 20 because a user without such a tool (e.g., a child in a safety restraint seat, or a prisoner under guard) would not be able to release the buckle without the tool. The cover 36 includes yet another design in which a small three-pointed-star-shaped opening 46 is provided, which can be, for example, designed to receive a special key for releasing the latch of the buckle 20. A variety of different designs can be provided for a buckle cover depending upon a desired application.

The replaceable covers provide a variety of benefits. For example, if the buckle 20 is used in a wheelchair application or in some other use in the health care industry, a health care provider, such as a physical therapist or doctor, can select a particular cover to suit a patient. For a patient with limited dexterity, the health care provider can select the cover 30, because the large opening 40 permits easy access to the button 38. On the other hand, for a patient at risk of accidentally or undesirably releasing a buckle, the health care provider can select the cover 34, because such cover cannot be opened without a tool or other object to insert into the opening 44. A variety of options are available, and the health care provider need not stock a large number of buckles, which could be expensive, but instead can maintain a variety of covers that that can be custom installed for individual patient needs. Furthermore, a patient's needs and abilities may change according to their age, mental capacity, and condition; it is therefore useful to permit a health care provider to make changes in the selection of the cover, according to the requirements of the time. Similarly, alternative shapes of button may be provided: a short or recessed button can limit access or prevent accidental opening, whereas a tall or raised button might permit a user with gloved hands to easily release the latch.

Other industries could benefit from interchangeable covers. The covers can be changed to provide desired button access, cover or button design or color, or to replace a damaged cover. In addition, the easily removable cover provides easy access to the internal workings of the buckle 20, permitting a quick inspection of the internal working parts or periodic cleaning and maintenance. For example, a diver may wish to remove the cover to rinse the buckle of salt water and sand as a precaution against jamming. Covers may be provided that include different printing on the covers, for instructions how to open a buckle, for example, or to provide advertising. In addition to differences in color or shape, such printing can facilitate the ready customization of buckles to suite a local preference, specialized branding, or regional language in the case of printed warnings.

As described above, a variety of different removable covers, such as the covers 30, 32, 34, and 36 can be used with a single push button buckle 20. For ease of reference, many embodiments herein are discussed only with respect to the removable cover 30. Describing the features with respect to a single cover 30 removes the need for duplication of description. However, unless specifically noted otherwise, when describing the removable cover 30, the features described with respect to that cover can be utilized on multiple different designs of covers, including, but not limited to, the covers 32, 34, 36.

Figure 2:
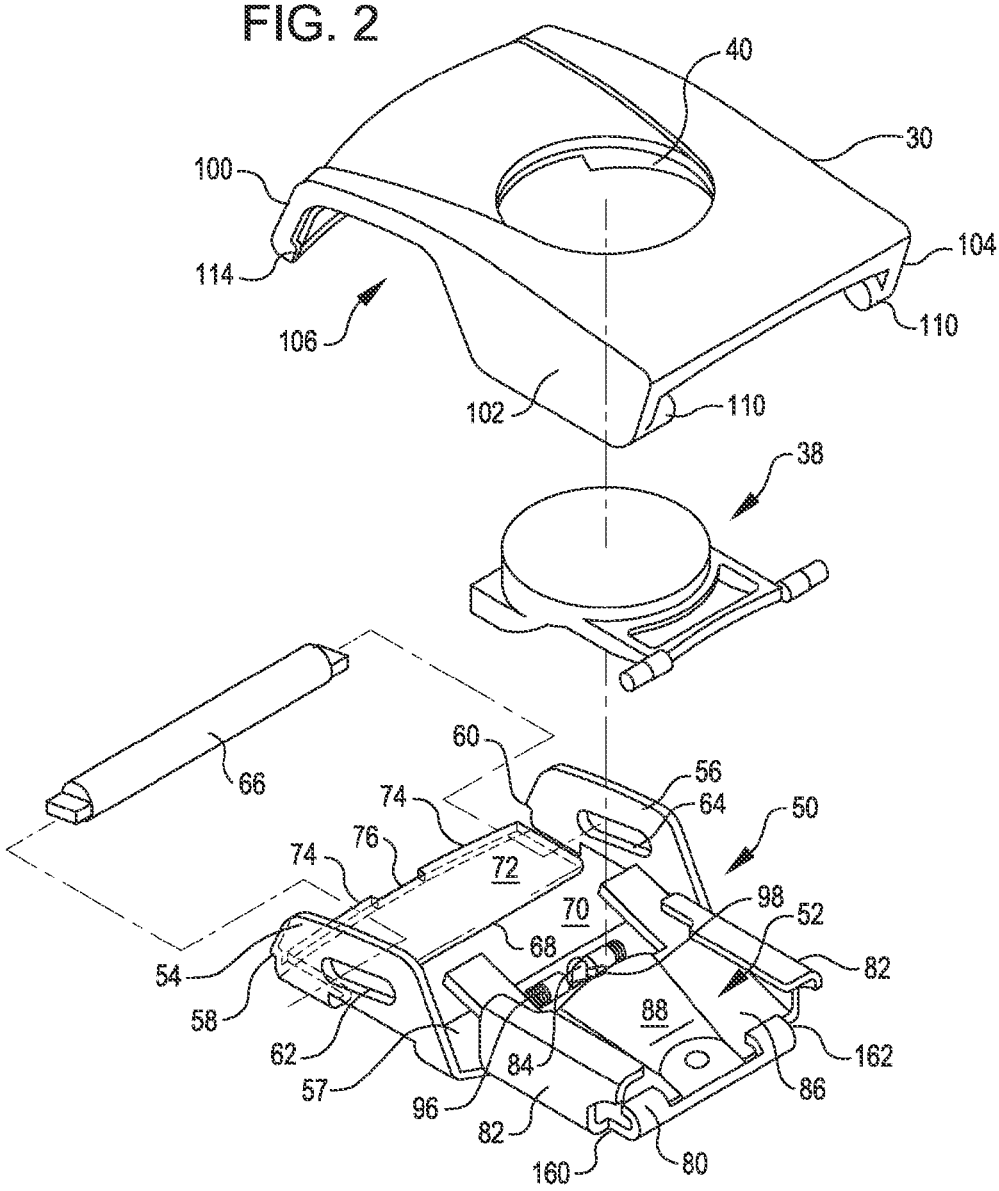
FIG. 2 is an exploded perspective view of the buckle of FIG. 1.
Figure 3:
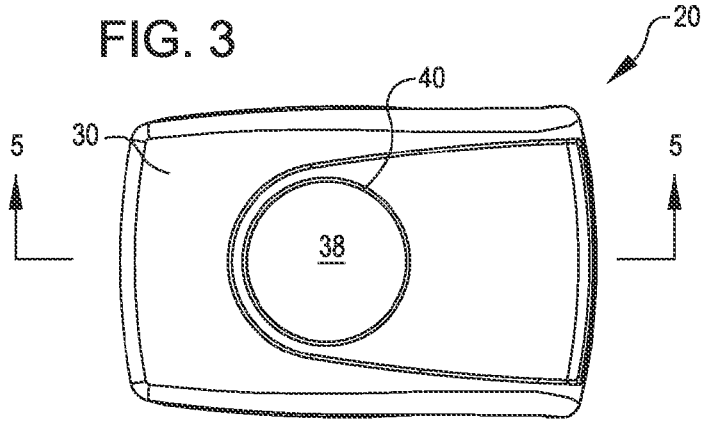
FIG. 3 is a top view of the buckle of FIG. 1.

FIG. 2 shows an exploded perspective view of the push buckle 20 in accordance with embodiments. In addition to the removable cover 30 and the push button 38, the push button buckle 20 includes a frame 50 and a latch plate assembly 52. When the removable cover 30 is installed, the inside of the removable cover is exposed to the latch plate assembly 52 and at least portions of the frame 50. In the embodiment shown in the drawings, the push button 38 is exposed through the large, round opening 40 and a portion of the push button is hinged inside the cover 30.

In embodiments, the frame 50 is made of a rigid structure, such as a metal or rigid composite or plastic. As an example, the frame can be formed from heat-treated carbon steel, but a variety of other different materials can be used. Features herein enjoy the benefit of a rigid frame, but a rigid frame is not required for all embodiments.

The tongue 22 can be provided out of a variety of different materials, but preferably is formed of a material that has a sufficient strength not to break during rough use and to resist bending or other damage. As an example, the tongue can be formed of a carbon steel similar to the carbon steel described for use with the frame, but in embodiments the tongue can be slightly thicker to reduce its wear on a strap.

The removable cover 30 can be formed of a variety of different materials, but preferably is formed of a material that is capable of some flexibility, but maintains its shape and has a resilience and bias so that it has a tendency to return to its original shape after flexing. As an example, the removable cover 30 can be formed of a plastic such as nylon or another suitable plastic. Many other plastics could be used, achieving a different balance of cost, durability, ease of molding or post-color printing. In embodiments, the removable cover is formed of plastic approximately 3 mm thick. However, other materials and thicknesses can be used depending upon the application and the desired final product.

The push button 38 can be manufactured from the same material as the cover, or another material that is suitable for an application. As examples, the push button 38 can be formed of plastic, metal, a composite, or another suitable material.

In an embodiment, the frame 50 is stamped out of a single piece of metal and shaped into the configuration shown in FIG. 2. The frame 50 shown in the drawings includes sidewalls 54, 56 extending upward from a base 57. The sidewalls 54, 56 each include a rear shoulder 58, 60 on a rear edge of the sidewall. The rear edges of the sidewalls slope downwardly and rearwardly to the rear shoulders 58, 60, and roughly straight down from there. The rear shoulders 58, 60 are arranged so that they are exposed downward; i.e., so that they act as protrusions on the rear edges that resist upward movement along the rear edges of the sidewalls 54, 56.

Figure 5:
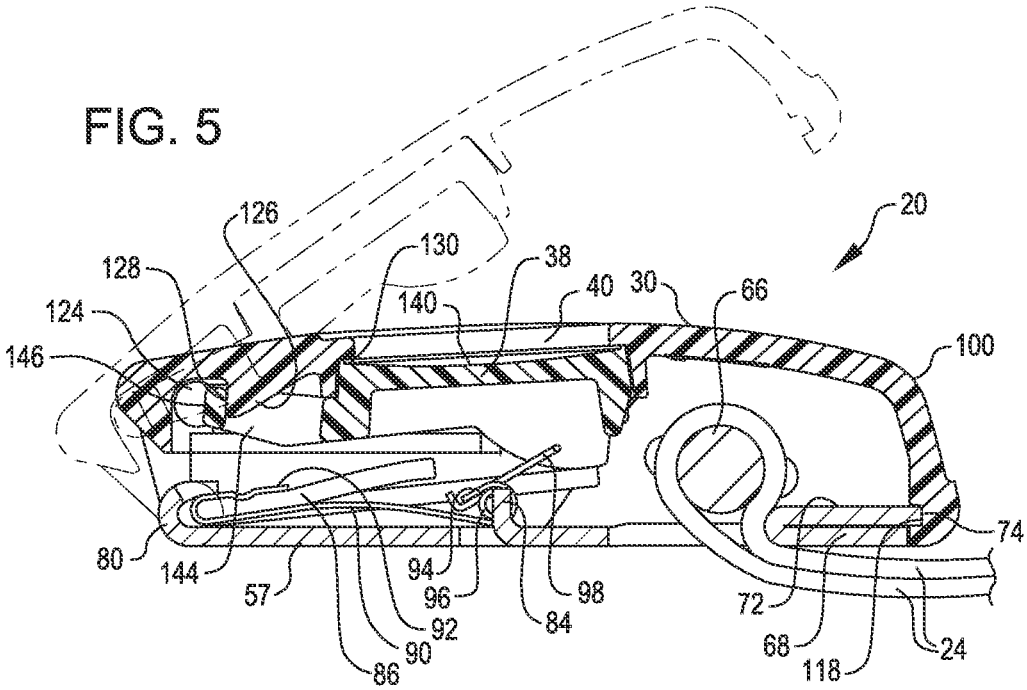
FIG. 5 is a section view taken along the section lines 5-5 in FIG. 3.

Each of the sidewalls 54, 56 includes a slot 62, 64 for receiving opposite ends of a knurled bar 66. In use, the strap 24 wraps around the knurled bar 66, as is shown in FIG. 5. The knurled bar 66 slides to lock the strap in position in a manner known in the art.

Figure 4A:
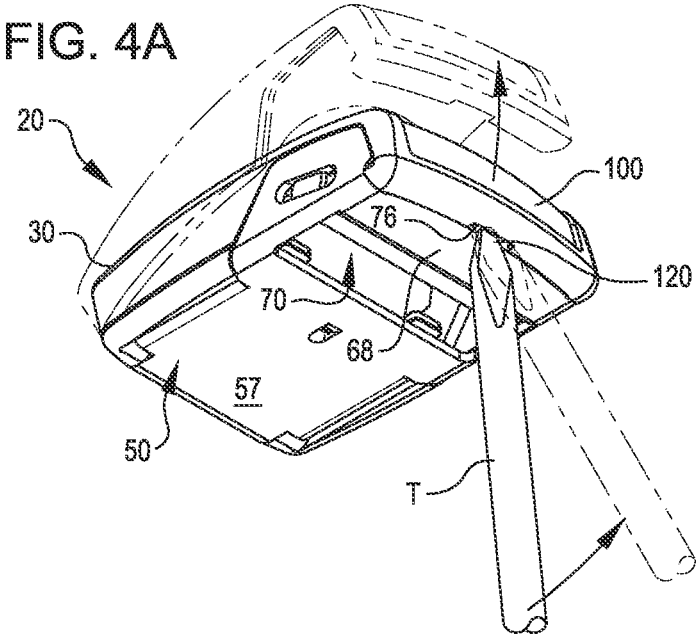
FIG. 4A is a bottom perspective view of the buckle of FIG. 1, with a tool inserted for removal of a cover of the buckle.
Figure 4B:
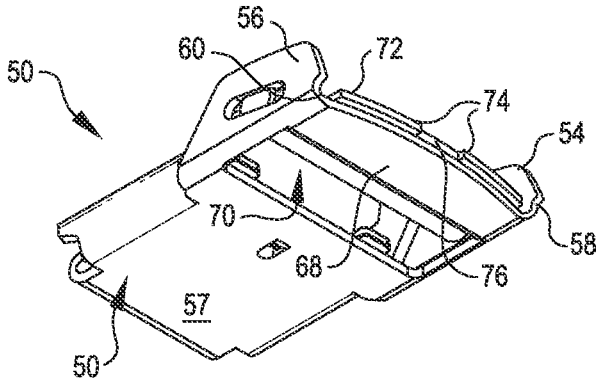
FIG. 4B is a bottom perspective view of the buckle of FIG. 4A, with the cover removed.

The base 57 includes a rear plate 68 and an opening 70 spaced forward from the rear plate. In embodiments where the frame is stamped from a single piece of metal, a tab 72 is cut and bent from the location of the opening 70 and folded over the top of the rear plate 68 so that the tab and the rear plate 68 are stacked on top of one another, as shown in FIG. 5. The tab 72 extends beyond the end of the rear plate 68 so as to form an elongate protrusion 74. A notch 76 (best shown in FIG. 4B) is centered on the elongate protrusion 74. Although the embodiments shown in the drawing include this doubled over tab structure, the rear portion of the frame can be formed in a different way, such as by molding or another suitable manufacturing process. However, applicants have found this doubled-over structure to work particularly well because the leading edge of the doubled over structure is rounded, presenting a smooth surface for the strap 24, and the double layer of metal provides rigidity for the frame 50.

A front portion of the frame 50 includes a rolled front lip 80 and front sidewalls 82 that extend over at right angles so as to form a partially enclosed sleeve at the front end of the frame 50. In use, the sleeve formed by the rolled front lip 80, the sides of the front sidewalls 82, and the top portion of the front sidewalls provides an opening into which the tongue 22 can be inserted.

Figure 6:
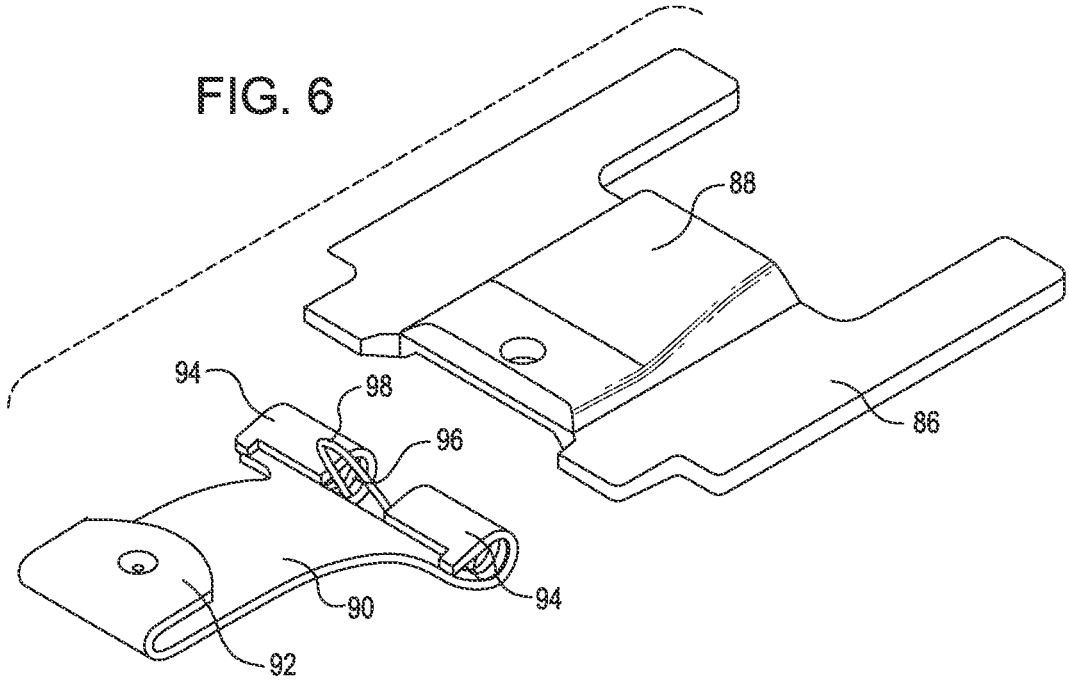
FIG. 6 is an exploded side perspective view of a latch plate assembly for use in the buckle of FIG. 1.
Figure 7:
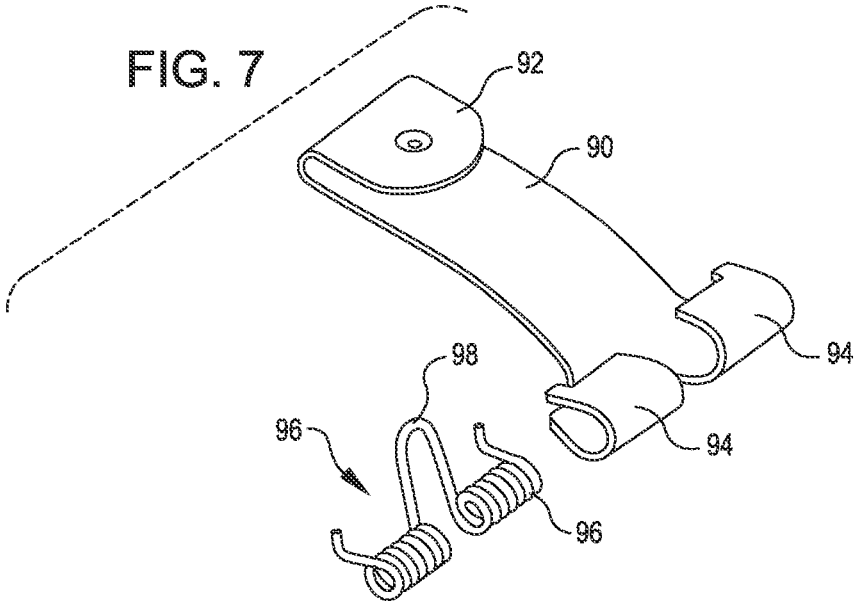
FIG. 7 is an exploded side perspective view of a latch spring and ejection spring for the latch plate assembly of FIG. 6.

A central tab 84 extends out of the base 57. The latch plate assembly 52 is installed between the rolled front lip 80 and the central tab 84. As best shown in FIG. 6, in embodiments, the latch plate assembly 52 includes a latch plate 86 having a central protrusion 88, and a latch spring 90 mounted under the latch plate. The latch spring 90 can be, for example, bent spring steel. The latch plate 86 can be formed of a suitable material and can be, for example, 1.5 mm thick carbon steel. As shown in FIG. 7, the latch spring 90 includes a bent over front portion 92 into which the latch plate 86 fits. The bent portion of the latch spring 90 fits underneath the latch plate 86, which, when installed in a frame 50, is compressed to create a preloaded stress in the spring to bias the latch plate 86 upward. The rear edge of the latch spring 90 includes a pair of rear loops 94, with a notch positioned between the two loops. In an embodiment, as shown in FIG. 7, an ejection spring 96 fits into the loops 94.

The bent nature of the latch spring 90 biases the latch plate 86 upward so that the central protrusion 88 can lock into an opening in the tongue 22. A user pressing downward on the push button 38 drives the rear edge of the latch plate 86 downward against the bias of the latch spring, allowing the central protrusion 88 to release the tongue 22 (if present).

Figure 8A:
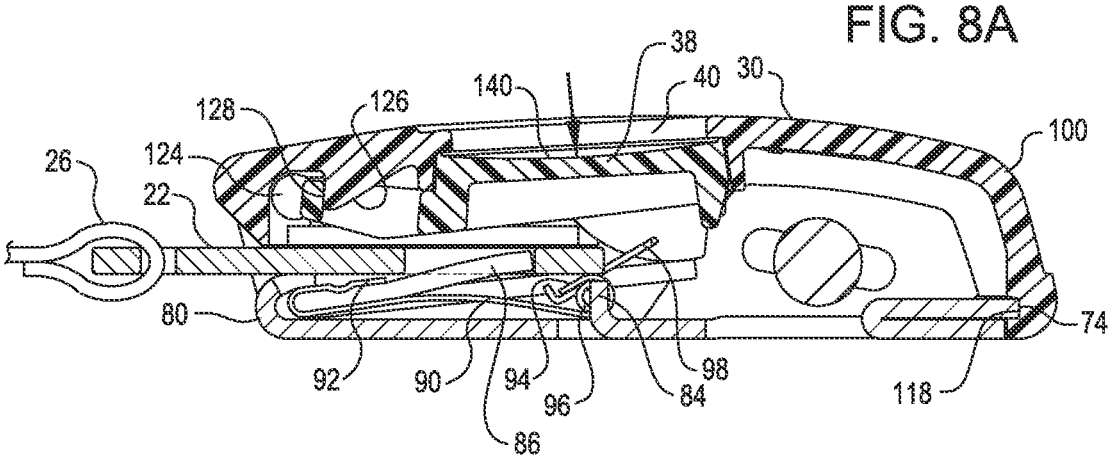
FIGS. 8A and 8B are diagrammatic representations showing action of an ejection spring as a tongue is inserted into the buckle of FIG. 1.
Figure 8B:
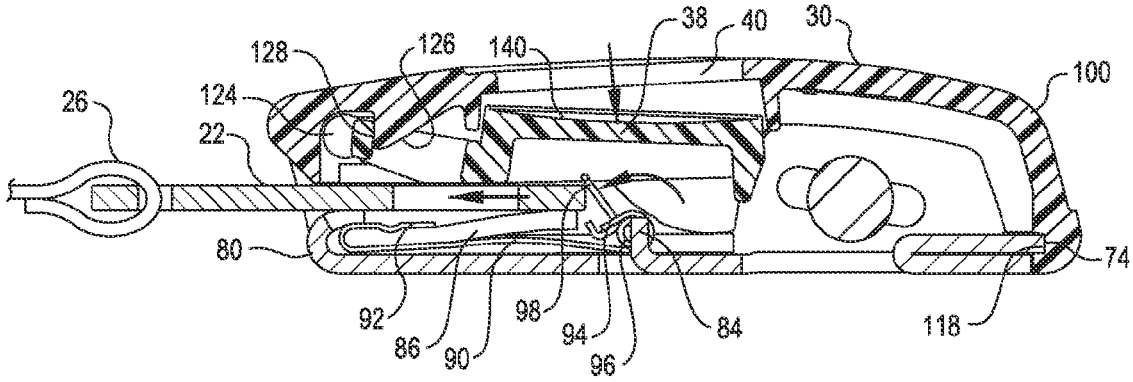

The ejection spring 96 is a torsion spring including a pair of coils having the same central axis and wound in opposite directions and leading up to a central loop 98. To install the ejection spring 96, the ejection spring is inserted into one loop 94 of the latch spring 90 and the central loop 98 of the ejection spring is centered in the notch between the two loops 94. The attachment of the ejection spring 96 to the latch spring 90 provides a combined structure for easy installation and consistent positioning of the ejection spring. Many prior art buckles either required the assembly of two separate springs (the loose ejection spring being prone to jamming or springing out of position), or have no ejection spring at all. As shown in FIGS. 8A and 8B, when the tongue 22 is inserted into the buckle 20, the tongue engages the central loop 98 of the ejection spring 96 and bends the central loop back against the coils of the ejection spring. When the push button 38 is pressed to release the tongue, the ejection spring 96 pushes the tongue out of the buckle 20.

Figure 9:
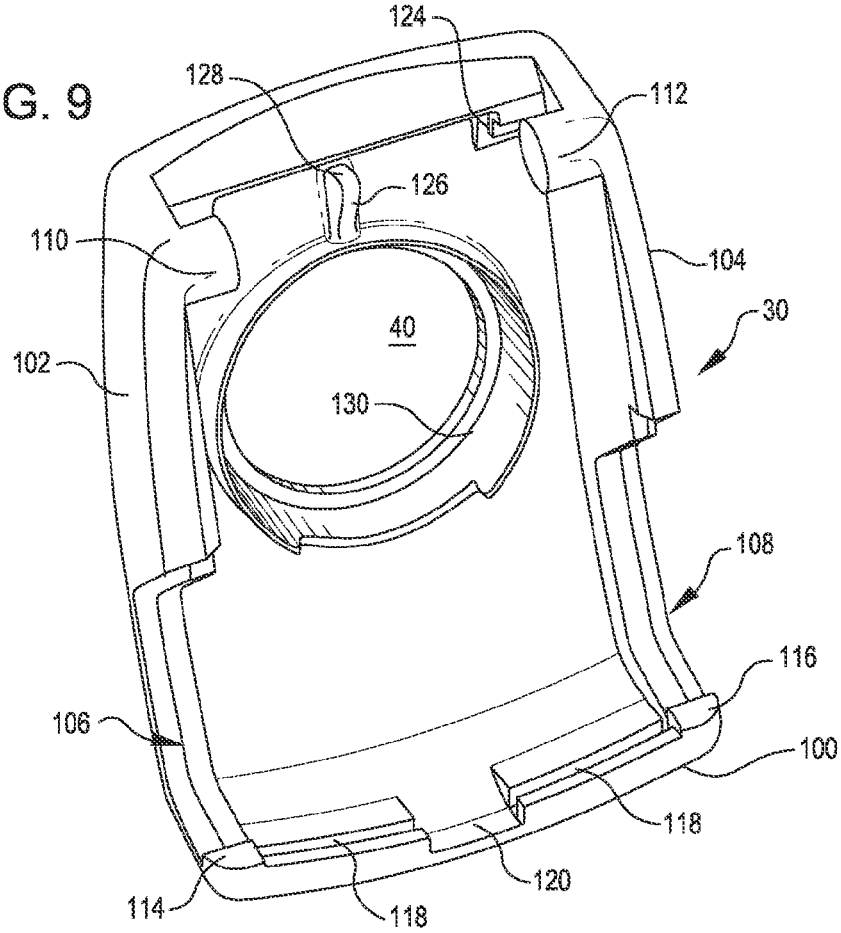
FIG. 9 is a bottom perspective view of the cover for the buckle of FIG. 1.

As shown in FIG. 9, the cover 30 includes a rear wall 100 and sidewalls 102, 104. Openings 106, 108 are positioned behind the sidewalls 102, 104 and are designed to receive the sidewalls 54, 56 of the frame 50. In a front, inside, lower portion of the sidewalls, an inwardly-directed, rounded protrusion 110, 112 extends from each of the sidewalls 102, 104.

At the rear, lower portion of the openings 106, 108, a pair of shoulders 114, 116 are located on opposite sides of the cover 30. These shoulders extend into the openings 106, 108 toward the front of the cover 30.

An elongate recess 118 extends along an inside lower edge of the rear wall 100, as shown in FIG. 8. A notch 120 extends vertically and is centered on the inside of the rear wall 100.

Two U-shaped, half circular openings 122, 124 are positioned inside opposite sides of the top of the rear wall 100. A triangular or dorsal-fin-shaped protrusion 126 is spaced from the rear wall and centered on the bottom of the upper wall of the cover 30. A front edge 128 of the protrusion 126 faces away from the rear wall 100.

As shown in FIG. 8, the opening 40 is positioned towards the central portion of the cover 30. An inset 130 extends around the opening 40 for receiving the button 38. In its resting state, the button 38 seats in the inset 130. The button 38 is pushed out of the inset during actuation.

Details of the push button 38 can be seen in FIGS. 2, 11, 12, 13, 14, and 15. A similar push button 38 can be utilized with each of the different covers 30, 32, 34, 36, although different shapes or configurations of push buttons can be utilized in the different covers. In general, a cover will include an opening through which a user can insert a finger, tool, or other structure to engage a button. The button is sized and shaped so that engagement by the tool, finger, or other structure causes the button to engage the latch plate assembly 52 to release the tongue 22 from the push button buckle 20. Embodiments herein utilize a button 38 that remains attached to a cover 30 and is removed with the cover. However, in alternate arrangements, the button can be removed from the cover and installed in a new cover, or the button can remain attached to the frame.

For the embodiments shown in the drawing, the push button 38 includes a push surface 140 that is a circular, flat surface that fits into the inset 130 and at least part of which is exposed through the openings 40, 43, 44, or 46. A shoulder 142 is positioned on opposite sides of the push surface 140 for seating the push button 138 against mating surfaces on the latch plate assembly 152.

Figure 13:
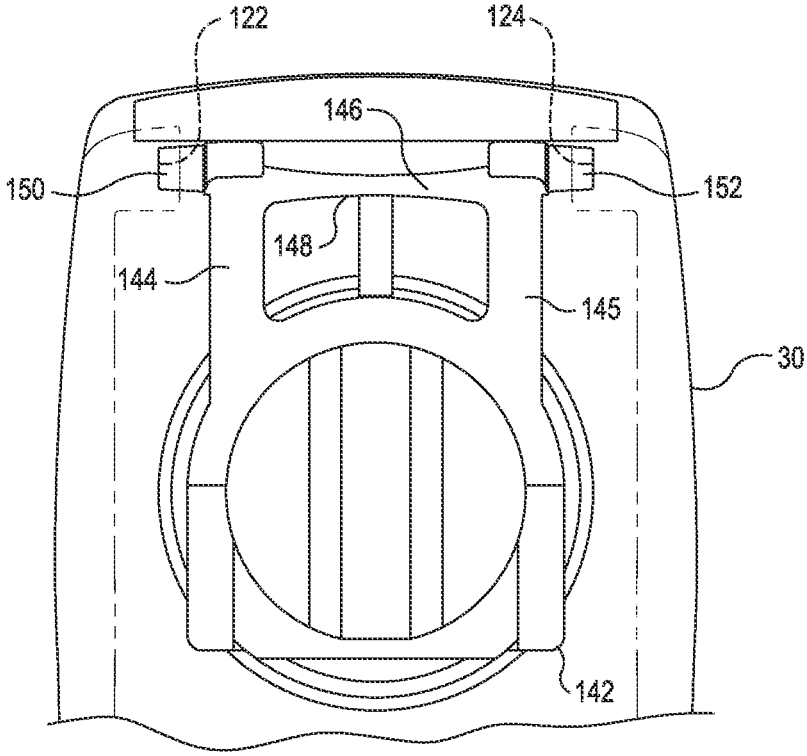
FIG. 13 is a bottom view of the push button of FIG. 12, shown installed in the cover of FIG. 8.

A pair of arms 144, 145 extend outward from the push surface 140 and are attached by the cross bar 146. The cross bar includes a rear surface 148. A pair of outer, axles 150, 152 are situated on opposite ends of the cross bar 146. As shown in FIG. 13, when the button 38 is installed, the axles 150, 152 fit into the U-shaped openings 122, 124. The axles 150, 152 are free to rotate in the U-shaped openings 122, 124, permitting the button 38 to rotate. In embodiments, the U-shaped openings extend around a portion of the axles 150, 152 so that the axles snap into place and do not fall out of the openings when the push button 38 is installed in the cover 30. As can be seen by the arrow in FIG. 11, after installed, the push button 38 can rotate about the axles 150, 152, upward into the opening 40.

As shown in FIG. 2, the frame 50 includes a pair of notches 160, 162 at lower, front edges. These notches 160, 162 are bounded on rear and top sides. The notches 160, 162 are used for installation of the cover 30 in accordance with embodiments described below.

Figure 10A:
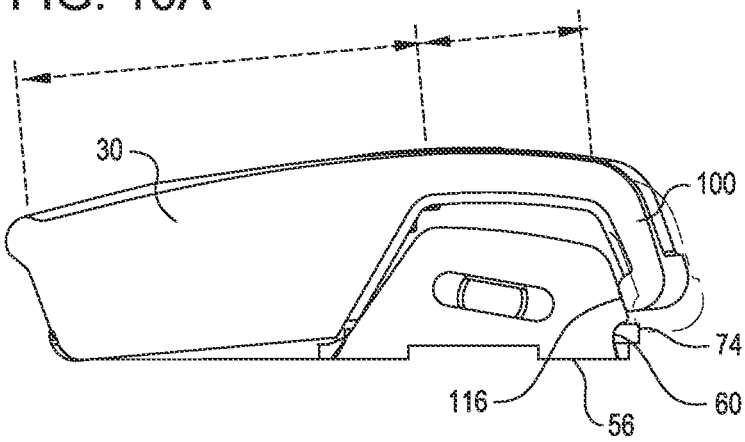
FIG. 10A is a diagrammatic representation of a stage of installation of the cover for the buckle of FIG. 1 onto a frame for the buckle in accordance with embodiments.
Figure 10B:
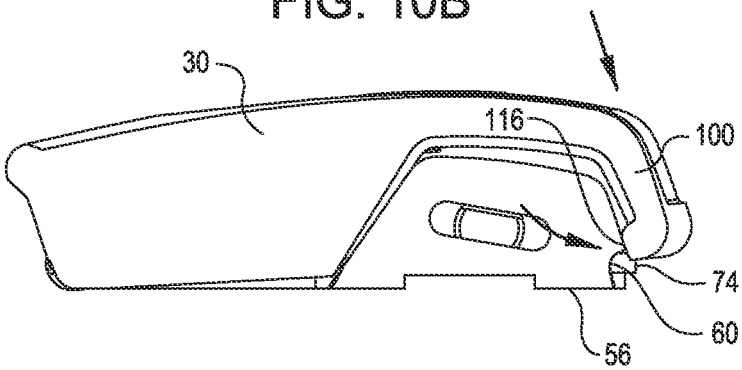
FIG. 10B shows a further stage of installation.
Figure 10C:
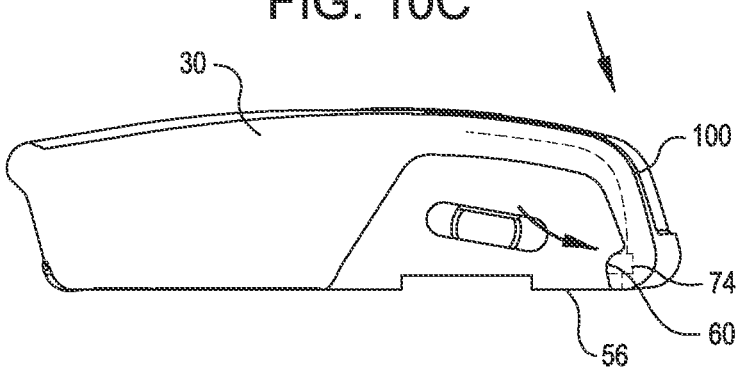
FIG. 10C shows still a further stage of installation.
Figure 11:
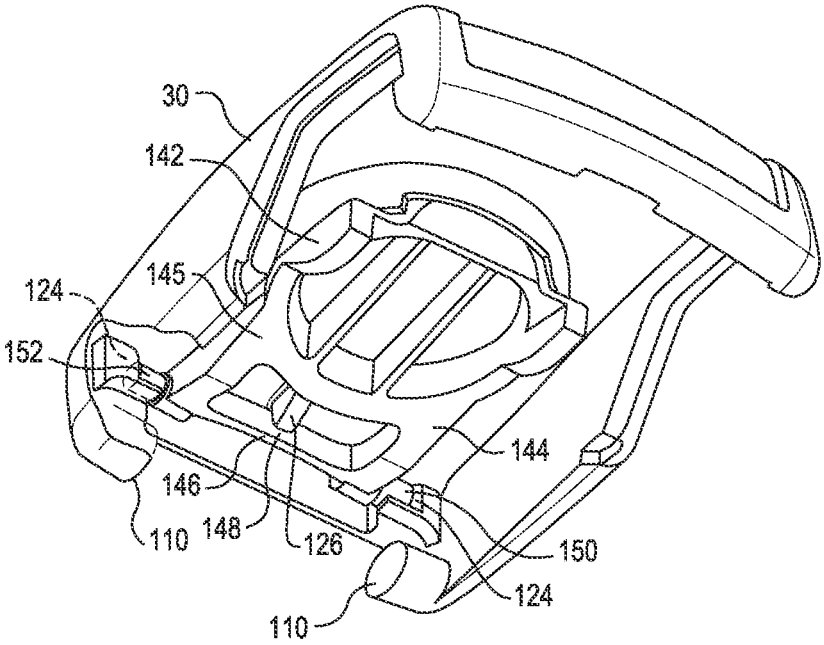
FIG. 11 is a bottom perspective view showing installation of a push button in the cover of FIG. 8.
Figure 12:
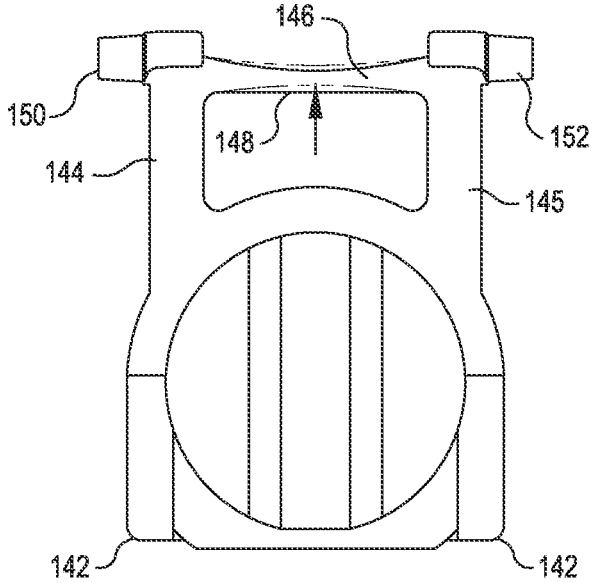
FIG. 12 is a bottom view of the push button of FIG. 11.

As shown in FIGS. 10A-10C, to install the cover 30, the inwardly directed, rounded protrusions 110, 112 on the cover 30 are inserted into the notches 160, 162 on the front of the frame. To align the protrusions 110, 112 with the notches 160, 162, the cover 30 is tilted relative to the frame 50 as shown by the phantom lines in FIG. 5. Tilting the cover 30 in this manner permits the rounded protrusions 110, 112 of the cover 30 to be installed without the rear wall 100 engaging the frame 50. After the rounded protrusions 110, 112 are installed in the notches 160, 162, the cover 30 is rotated downward so that the rear wall moves toward the rear of the frame 50. As the rear wall 100 rotates downward, the shoulders 114, 116 engage the rear surfaces of the sidewalls 54, 56 of the frame 50, as shown in FIG. 9. As described above, these rear surfaces are sloped outward and downward, so eventually free rotation of the cover 30 about the rounded protrusions 110, 112 is stopped by the engagement of the shoulders 114, 116 with the rear surfaces of the sidewalls 54, 56 of the frame 50.

As described above, in embodiments, the cover 30 is flexible and the frame 50 is rigid. This arrangement permits the cover 30 to flex to stretch the outer edges of the openings 106, 108 to lengthen the cover. Thus, pressing the cover 30 down when the shoulders 114, 116 engage the rear surfaces of the sidewalls 54, 56 of the frame 50 causes the cover 30 to flex, moving the rear shoulders 114, 116 rearward and downward along the sloped rear surfaces of the sidewalls. Continued movement downward of the cover 30 is resisted by the resistance of the cover to flexing and bending. However, by applying enough pressure, this resistance can be overcome, causing sufficient flexion of the cover 30 to permit the shoulders 114, 116 to continue to move rearward and downward. At a point, the shoulders 114, 116 are moved rearward and downward to the rearmost apex of the sidewalls 54, 56 of the frame, just above the rear shoulders 58, 60 on the frame. At this point, the area on the inside of the cover 30 adjacent to the elongate recess 118 is aligned just above the elongate protrusion 74 on the frame. Further movement of the cover 30 downward causes the shoulders 114, 116 on the cover to move just below the rear shoulders 58, 60 on the frame. At this point, the rear portion of the frame is supported rearward by contact of the portion of the inside of the cover 30 adjacent to the recess 118 with the elongate protrusion 74 on the frame. The cover can then be pushed downward until the recess 118 aligns with the protrusion 74, and snaps in place over the protrusion. An audible click can provide feedback that the cover is locked in place. The shoulders 114, 116 on the cover 30 fit under the rear shoulders 58, 60 on the frame 50. The slope under the rear shoulders 58, 60 permits the shoulder 114, 116 on the cover 30 to move back forward, returning the cover to a substantially unstretched state, remaining stretched just enough to take up any gaps and provide a secure, wiggle-free fit. At this point, the openings 106, 108 fit around the sidewalls 54, 56 on the frame, and the cover is locked into position by the connection of the recess 118 around the protrusion 74, and the positioning of the shoulders on the cover 30 under the rear shoulders 58, 60 on the frame 50.

To remove the cover 50, a tool T (FIG. 4A), such as the blade of a screwdriver, is inserted into the slot formed by the two notches 76, 120. The two notches 76, 120 form an opening for receiving the tool T. This opening is thus a tool receiving structure. Inserting the tool in this manner allows the user to pry the cover 30 rearward, against the resistance of the cover to flexion, removing the protrusion 74 from the recess 118. Continued prying allows the cover to slide off the back of the frame. Other tool receiving structures may be used. For example, a notch or opening may be provided in only one of the frame 50 and the cover 30. A tab or protrusion on either the frame 50 or cover 30 could be designed to receive a prying tool or other tool.

As an alternative to the tool receiving structure, a screw or other fastener or connector may releasably lock the cover 30 to the frame 50 and may be removed by use of a tool such as a screwdriver or punch.

The removal process above can be done with the strap or webbing 24 connected to the push button buckle 20. The arrangement of the opening 70 at the bottom of the frame 50, and the fact that the webbing 24 inserts into this opening, wraps around the knurled bar 66 and extends back out of the opening means that the webbing does not extend through or otherwise interfere with removal and replacement of the cover 30. Thus, the cover 30 can be removed and replaced with an additional cover without removing the buckle 20 from the strap 24. This feature permits the installer to replace a cover without having to remove and replace the strap.

Alternatives to the arrangement above can be provided. In general, in accordance with embodiments, the cover flexes to snap onto the frame, and is removed with a tool (again, by flexing the cover). In embodiments, the cover 30 is difficult if not impossible to remove without a tool so that accidental removal does not occur. To this end, the sidewalls 102, 104 of the cover can be thicker than the center to provide rigidity and to hold the cover in place. Moreover, the locking nature of the recess 118 and the protrusion 74, along with the positioning of the shoulders 114, 116 on the cover 30 under the rear shoulders 58, 60 on the frame 50, requires almost straight outward movement of the rear wall 100 of the cover 30 from the frame 50 to release the cover. Both of these arrangements require that the rear wall 100 of the cover 30 be bent outward a significant distance before the cover can be removed, ensuring that removal without leverage, such as by hand or a fingernail, is difficult. In the embodiments shown in the drawing, the notches 76, 120 provide the only opportunity for leveraged removal of the cover 30, thus permitting a tool to be inserted and remove the cover in a leveraged manner. Different arrangements for locking the cover 30 into place, including different protrusions, recesses, snaps, or other locking features can be used. In addition, other arrangements can be provided for providing leveraged removal, but in embodiments, a tool is used for removal.

The arrangement of the cover 30 and the frame 50 also permits easy installation. The cover 30 hooks onto the front of the frame, rotates around and downward, and is snapped into place. This snapping motion can be done with a single hand, taking advantage of the leverage provided by the sloped back edges of the frame. To this end, the shoulders on the cover 30 act as engagement surfaces that ride along the sloped back surfaces, which act as cams.

In accordance with embodiments, as described above, the push button 38 can remain attached to the cover 30 during installation and removal of the cover. In addition, in accordance with embodiments, the push button can bias into the opening 40 so that the button does not swing down during installation of the cover 30. To provide this function, a structure can be provided that biases the button 38 toward the opening 40 in the cover 30. This structure can bias the button 38 a sufficient amount to hold the button in place, yet not prevent use of the button to release the tongue. As an example, a spring with a low spring constant can be used to bias the button 38 into the opening 40. The resistance to movement downward would be very small in comparison to the force required to operate the buckle 20. Thus, the resistance would not be noticed by a user, or would be negligible, when the user is operating the buckle 20.

Figure 14:
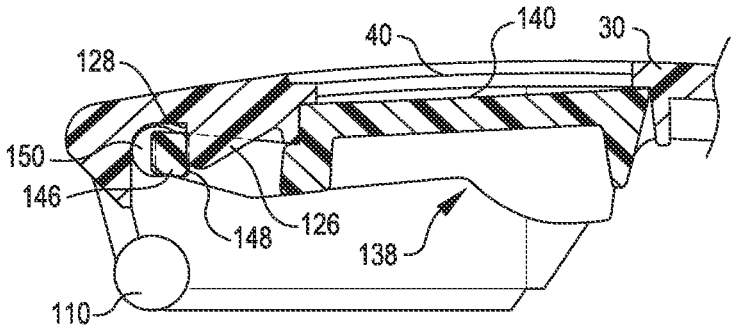
FIG. 14 is a section view showing push button of FIG. 12, shown installed in the cover of FIG. 8, without the button depressed.
Figure 15:
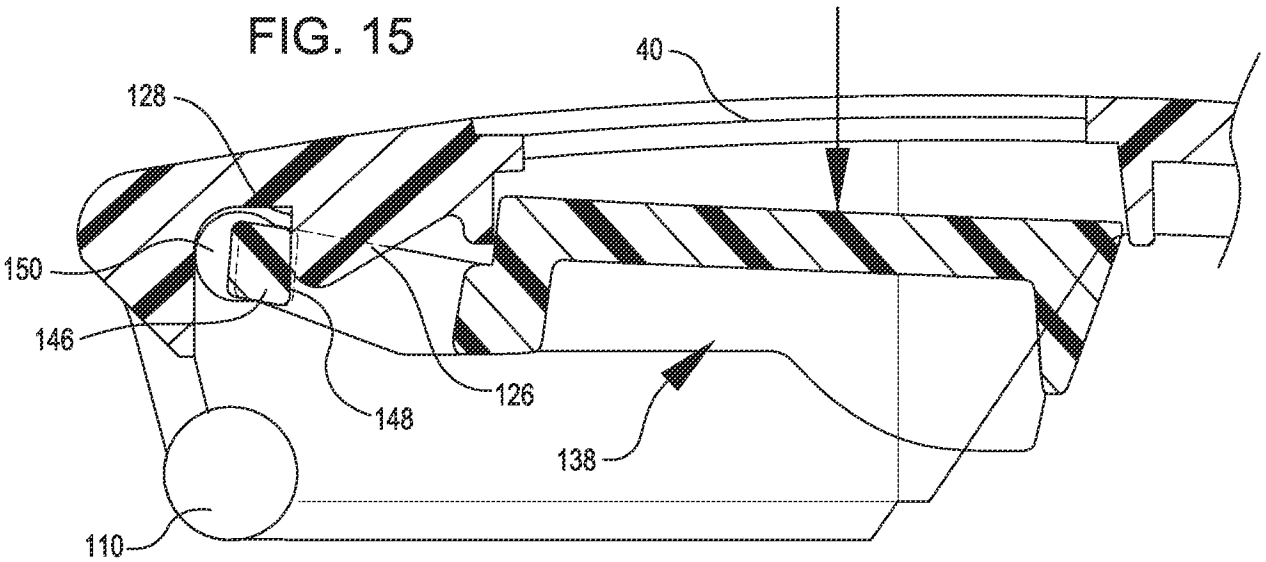
FIG. 15 is a section view showing push button of FIG. 12, shown installed in the cover of FIG. 8, with the button depressed.

In embodiments shown in the drawing, this structure is provided by the engagement of the cross bar 146 of the button 38 with the triangular-shaped protrusion 126 on the bottom of the cover 30. As can be seen in FIG. 14, when the push button 38 is installed, the rear surface 148 of the cross bar 146 engages the front surface 128 of the triangular-shaped protrusion 126. In embodiments, the cross bar is flexible and presses against the front surface 128 of the triangular-shaped protrusion 126. The pressure on the front of the protrusion 126 exerted by the cross bar 146 is sufficient to hold the button in place. However, this pressure does not impede actuation of the button. To this end, the bias of the push button 38 into the closed position is sufficient to sustain the weight of the push button and to prevent accidental dislodgement of the button without some force.

To assemble the button 38 in the cover 30, the button is oriented at 90° to the horizontal cover and slid forward such that it is passed under the triangular protrusion 126 in the underside of the cover. The axles 150, 152 on the button 38 are then pressed forward so that they are captured in the u-shaped pockets 122, 124 at either side of the cover. In this position, the button 38 cannot fall out, but is free to rotate. The button 38 is then rotated upwards into the horizontal position, with the center bar 146 wiping against the forward surface 128 of the triangular protrusion 126. In this position, there is slight interference (e.g., 0.25 mm) between the center bar 146 and the triangular protrusion 126, causing the center bar to bend in the middle. The engagement of the flat front surface 128 of the triangular protrusion 126 and the rear surface 148 of the center bar 146 causes stress and interference to be highest when the button is tipped down about 10° (the stress results in a slight bending and torsion of the center bar). As the button 38 is tipped up to the 0° horizontal position, the interference and stresses are reduced slightly, but still present. The affect is to predispose the button 38 to remain snapped into the fully horizontal position, pressing upwards against the inside of the cover 30. The force required to depress the button is very small (e.g., 0.1 lb.), due to ratio of the levers and low forces involved, but the spring force supplied by the interference fit is enough to overcome the effects of gravity and any shaking which might otherwise cause the button to swing down out of position.

This feature is useful because it keeps buttons from getting entangled or coming loose when hundreds of assembled parts are shipped, and aids the production assembler or eventual user to snap the cover 30 in place on the metal frame 50, without having to worry about holding the button up in the correct position as the cover is tipped into place.

When the cover 30, button 38, and frame 50 are fully assembled, the spring/snap feature of the button 38 has a negligible affect on the buckle's action. As the cover is snapped onto the frame, the button 38 comes into contact with the latch plate 86. The button 38 crowds the latch plate 86 down (approximately 2°), and the force of the preload in the latch spring presses back against the button. When a user wishes to unlock the buckle 20 (to release the tongue 22), the user must depress the button (approx. 6°), at which angle the latch plate releases the inserted tongue, allowing the tongue 22 to eject. The tongue 22 is further encouraged to eject by the action of the ejection spring 96 pressing against its tip.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A method comprising:

providing parts of an unassembled buckle, the parts including at least a frame of the buckle and a cover of the buckle, the frame having a latching mechanism mounted in the frame, the cover having an opening defined through the cover;

attaching a first end of the cover to the frame;

rotating the cover on the frame and about the first end; and pressing a second end of the cover downward, causing the cover to lock around a structure on the frame, wherein, when the cover is locked around the structure on the frame, the opening defined through the cover is aligned with the latch mechanism for actuation of the latch mechanism through the opening.

2. The method of claim 1, wherein rotating the cover comprises:

engaging an engagement surface of the cover with a sloped surface of the frame;

pressing the cover downward, causing the engagement surface to move along the sloped surface, thus flexing the cover; and releasing the flex of the cover to lock the cover around the structure on the frame.

3. The method of claim 1, further comprising, removing the cover by:

inserting a tool into a notch formed between a frame for the buckle and a first covered for the buckle; and prying the cover off the frame using the tool.

4. The method of claim 1, wherein, when the cover is locked around the structure on the frame, an inside of the cover is exposed to the latch mechanism.

5. The method of claim 1, further comprising, prior to causing the cover to lock around a structure on the frame, providing a button, and wherein the frame and the cover are positioned so that the push button is positioned for actuation of the latching mechanism through the opening defined through the cover when the cover is locked around the structure on the frame.

6. The method of claim 1, further comprising, prior to causing the cover to lock around a structure on the frame, providing a button, and wherein when the cover is locked around the structure on the frame the frame and the cover are positioned so that:

i) a bottom side of the push button is exposed to the latching mechanism and the frame; and ii) a top side of the push button is exposed to an exterior of the buckle through the opening defined through the cover.

7. The method of claim 1, further comprising, prior to causing the cover to lock around a structure on the frame, providing a button, and wherein the button is captured between the cover and the frame when the cover is locked around the structure on the frame.

8. A push button buckle, comprising:

a frame forming a first part of the push button buckle when the push button buckle is assembled, the frame comprising a latch mechanism mounted therein, a main locking surface, a pivot mount; and a cover forming a second part of the push button buckle when the push button buckle is assembled, the cover releasably mounted to the frame, the cover comprising:

a pivot base configured to releasably mount to the pivot mount on the frame, wherein when the pivot base is mounted to the pivot mount, the cover may be rotated relative to the frame toward an installed position;

a mating locking surface configured to engage with the main locking surface on the frame when the cover is rotated relative to the frame to the installed position, wherein, when the cover is rotated to the installed position, the cover engages the locking surfaces and the engagement of the locking surfaces and the engagement of the pivot mount to the pivot base maintains the cover in place on the frame; and an opening defined through the cover, the opening aligned with the latch mechanism for actuation of the latch mechanism through the opening when the cover is in the installed position, wherein an inside of the cover is exposed to the latch mechanism when the cover is in the installed position.

9. The push button buckle of claim 8, wherein the frame comprises a sloped leading guide surface, and wherein the cover comprises:

a material that is flexible and resilient;

a following guide surface configured to engage the leading guide surface on the frame to orient the cover when the cover is rotated relative to the frame toward the installed position, wherein the engagement of the guide surfaces and the flexibility of the material cause the cover to flex from an unexpanded state toward an expanded state during rotation of the cover relative to the frame toward the installed position; and wherein the resiliency of the material causes, when the cover is rotated to the installed position, the cover to flex back from the expanded state toward the unexpanded state to cause the engagement of the locking surfaces and maintain the cover in place on the frame.

10. The push button buckle of claim 9 wherein the cover further comprises cover side walls, each cover sidewall having a portion removed to form a cover side wall contour, and wherein the frame further comprises frame sidewalls, the frame sidewalls comprising the leading guide surface and a frame sidewall contour, wherein when the cover has been rotated relative to the frame to the installed position, the cover sidewall contour matches the frame sidewall contour.

11. The push button buckle of claim 9, wherein the leading guide surface comprises the main locking surface.

12. The push button buckle of claim 9, wherein the leading guide surface terminates in the main locking surface.

13. The push button buckle of claim 9, wherein the following guide surface comprises the mating locking surface.

14. The push button buckle of claim 9, wherein the following guide surface terminates in the mating locking surface.

15. The push button buckle of claim 9, wherein the leading guide surface extends toward an exterior of the frame.

16. The push button buckle of claim 8 wherein one of the main locking surface and the mating locking surface comprises a recess, and the other of the main locking surface and the mating locking surface comprises a protrusion, and wherein the protrusion seats in the recess when the cover has been rotated relative to the frame to the installed position.

17. The push button buckle of claim 8, wherein the buckle comprises at least one of a shoulder lock and a recess protrusion lock, wherein the shoulder lock comprises a main shoulder on the main locking surface on the frame and a mating shoulder on the mating locking surface on the cover, wherein when the mating shoulder passes from a first side of the main shoulder to a second side of the main shoulder when the cover is rotated relative to the frame to the installed position, the mating shoulder shifts away from the exterior of the frame to engage with at least the second side of the main shoulder; and wherein the recess protrusion lock comprises a recess in one of the main locking surface and the mating locking surface and a protrusion on the other of the main locking surface and the mating locking surface , and wherein the protrusion seats in the recess when the cover has been rotated relative to the frame to the installed position.

18. The push button buckle of claim 8, wherein the cover further comprises cover side walls, wherein the sidewalls are thicker than a center of the cover and provide enhanced resilience to the cover to hold the cover in place.

19. The push button buckle of claim 8, wherein guiding and locking surfaces are located on a rear end of the buckle and the pivot base and pivot mount are located at a front end of the buckle opposite the rear end, wherein the pivot base comprises a pair of posts located on opposing sides of the front end of the cover and the pivot mount comprises a pair of rounded openings located at the front end of the frame, with each rounded opening configured to receive one of the posts for rotational movement of the cover about the posts.

20. The push button buckle of claim 8, wherein a push button is hingedly mounted to the cover and operable to actuate the latch mechanism when the cover has been rotated relative to the frame to the installed position.

21. The push button buckle of claim 20, wherein the push button is detachable from the cover.

22. The push button buckle of claim 20, wherein the push button remains attached to the cover when the cover is rotated relative to the frame toward the installed position.

23. The push button buckle of claim 20, wherein the push button and the latch mechanism are configured so that hinged rotation of the push button relative to the frame operates to actuate the latch mechanism when the cover has been rotated relative to the frame to the installed position.

24. The push button buckle of claim 8, further comprising an opening in at least one of the cover or frame for receiving a tool for removing the cover.

25. The push button buckle of claim 24, wherein the opening comprises a notch.

26. The push button buckle of claim 8, further comprising a tool receiving structure formed between the cover and the frame when the cover has been rotated relative to the frame to the installed position, the tool receiving structure for receiving a tool for prying the cover off the frame.

27. push button buckle of claim 26, wherein the tool receiving structure comprises an opening.

28. The push button buckle of claim 8, wherein a push button is biased into contact with the cover to aid in rotating the cover relative to the frame toward the installed position.

29. The push button buckle of claim 28, wherein the push button is biased by contact of a spring loaded surface on the push button with a surface on the cover.

30. The push button buckle of claim 29, wherein the push button further comprises a flexible cross bar and the cover further comprises a protrusion, wherein the cross bar is configured to press against the protrusion with sufficient pressure to bias the push button into contact with the cover to aid in rotating the cover relative to the frame toward the installed position.

31. The push button buckle of claim 8, wherein the latch further comprises:

a latch plate mounted in the frame and movable between a release position in which a tongue is removable from the buckle and a lock position in which the tongue is locked in the buckle;

a latch spring mounted in the frame to bias the latch plate to the lock position; and an ejection spring, attached to but separate from the latch spring, for aiding in ejecting a tongue from the buckle.

32. The push button buckle of claim 31, wherein the latch spring comprises a leaf spring mounted under the latch plate and having at least one loop at one end, and the ejection spring comprises a torsion spring mounted in said at least one loop of the leaf spring.

33. A replacement cover for use with the push button buckle of claim 8.

34. The push button buckle of claim 8, wherein the mating locking surface is configured to engage with the main locking surface on the frame after the following guide surface of the cover has released from the leading guide surface of the frame when the cover is rotated relative to the frame to the installed position, the engagement of the locking surfaces holding the cover in place on the frame.

35. The push button buckle of claim 8, wherein the cover further comprises cover sidewalls and the frame further comprises frame sidewalls, at least a portion of the frame sidewalls being coplanar with at least a portion of the cover sidewalls when the cover is in the installed position.

36. The push button buckle of claim 8, further comprising a push button captured between the cover and the frame when the cover is in the installed position.

37. The push button buckle of claim 8, further comprising a push button positioned for actuation of the latching mechanism through the opening defined through the cover when the cover is in the installed position.

38. The push button buckle of claim 8, further comprising a push button having a top side and a bottom side, wherein, when the cover is in the installed position, the bottom side of the push button is exposed to the latching mechanism and the frame and the top side of the push button is exposed to an exterior of the push button buckle through the opening defined through the cover.

* * * * *

UNITED STATES PATENT AND TRADEMARK OFFICE

CERTIFICATE OF CORRECTION

PATENT NO. : 8,776,332 B2
APPLICATION NO. : 12/716969
DATED : July 15, 2014
INVENTOR(S) : Matthew Kosh and John N. Tilden It is certified that error appears in the above-identified patent and that said Letters Patent is hereby corrected as shown below:

In the claims

Column 11, Line 66, Claim 3, replace “covered” with “cover”

Column 12, Line 31, Claim 8, add “and” after “surface,” and before “a pivot mount”

Column 14, Line 16, Claim 27, add “The” at the beginning of the claim

Signed and Sealed this
Fifth Day of April, 2016

Michelle K. Lee

Michelle K. Lee
*Director of the United States Patent and Trademark Office*